United States Patent [19]

Gorin

[11] 4,134,821

[45] Jan. 16, 1979

[54] MAINTENANCE OF SOLVENT BALANCE IN COAL LIQUEFACTION PROCESS

[75] Inventor: Everett Gorin, San Rafael, Calif.

[73] Assignee: Continental Oil Company, Stamford, Conn.

[21] Appl. No.: 802,382

[22] Filed: Jun. 1, 1977

[51] Int. Cl.[2] ..... C10G 1/04; C10G 1/08

[52] U.S. Cl. ..... 208/8; 208/10

[58] Field of Search ..... 208/8, 10

[56] References Cited

U.S. PATENT DOCUMENTS

| | | | |
|---|---|---|---|
| 3,018,241 | 1/1962 | Gorin | 208/8 |
| 3,583,900 | 6/1971 | Gatsis | 208/8 |
| 3,796,653 | 3/1974 | Gatsis | 208/309 |
| 3,954,595 | 5/1976 | Sze et al. | 208/10 |
| 3,974,073 | 8/1976 | Sze et al. | 208/8 |
| 4,029,567 | 6/1977 | Farnand et al. | 208/8 |
| 4,040,957 | 8/1977 | Sze et al. | 208/8 |

*Primary Examiner*—Delbert C. Gantz
*Assistant Examiner*—Joan Thierstein
*Attorney, Agent, or Firm*—F. Lindsey Scott; William A. Mikesell, Jr.; D. Leigh Fowler, Jr.

[57] ABSTRACT

A coal liquefaction process is provided in which a solvent is used to at least partially liquefy the coal. The process is maintained in solvent balance without extraneous addition of make-up solvent. The required balance is effected by selectively recovering from the liquefaction product an oil-containing liquid phase, at least a portion of the liquid phase being thereafter hydrogenated to form coal solvent in sufficient amount to replenish that lost. The selective recovery of the desired liquid phase is effected by means of a deasphalting solvent that preferentially separates asphaltenes and benzene insolubles from the coal extract.

5 Claims, 2 Drawing Figures

MAINTENANCE OF SOLVENT BALANCE IN COAL LIQUEFACTION PROCESS

Figure 1:
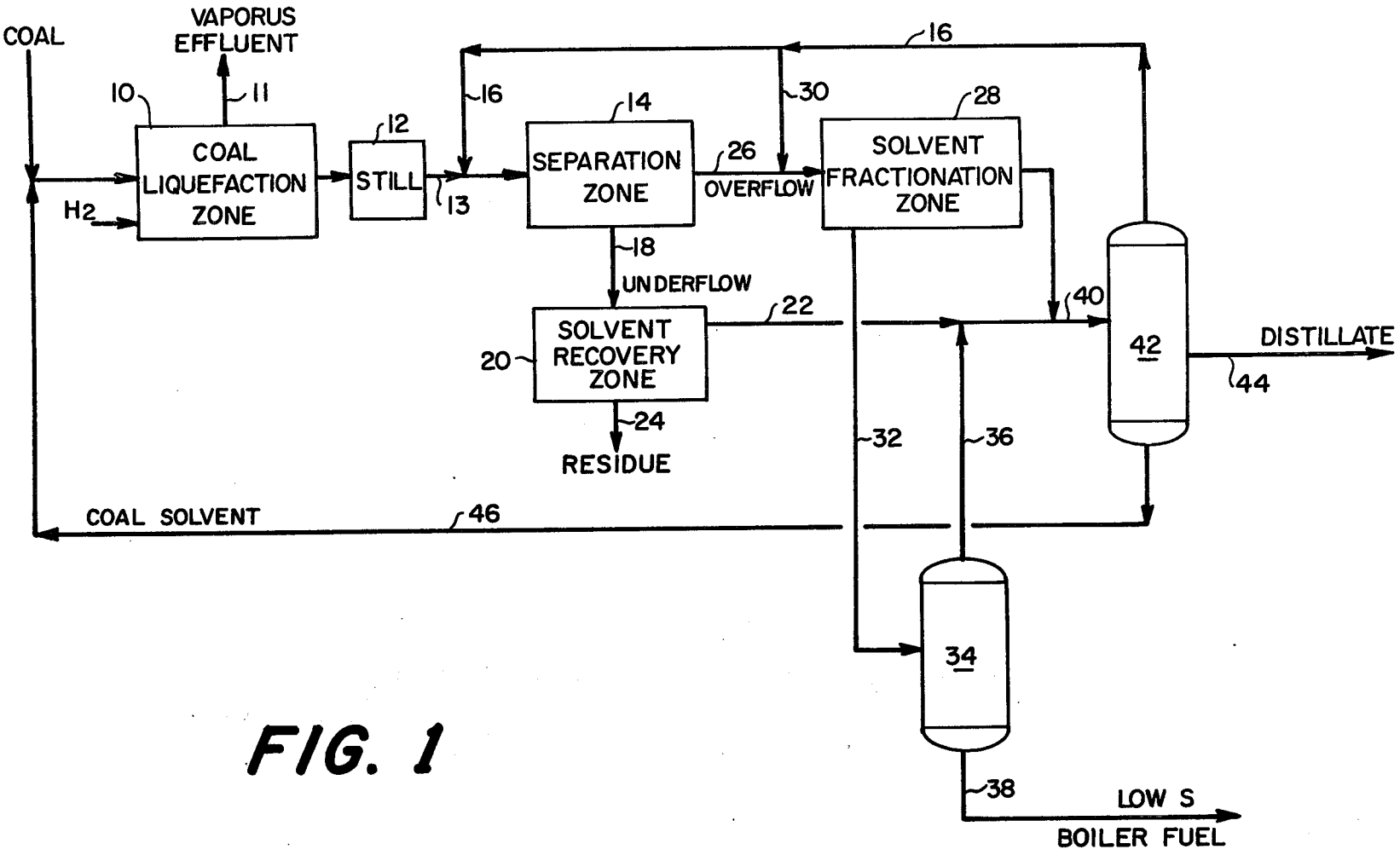

This invention relates to coal liquefaction processes, and, more particularly, to those processes in which a distillable coal solvent is used to dissolve coal in a coal liquefaction zone, to yield both distillable and non-distillable products.

For the purposes of this application, the terms "coal extract" or simply "extract" means the non-distillable portion (exclusive of undissolved residue) of the coal liquefaction product. The coal extract may be subdivided into the following three fractions;

(1) Benzene-Insolubles — that fraction which is insoluble in benzene at its atmospheric pressure boiling point. This is the highest molecular weight fraction and usually contains the highest nitrogen, oxygen and sulfur (NOS) content, and the lowest hydrogen content.

(2) Asphaltenes — that fraction of the benzene-soluble material which is insoluble at room temperature in 100 parts of cyclohexane and 9 parts of benzene. This fraction is intermediate in both molecular weight and hydrogen content.

(3) Oil — that fraction which is soluble in both benzene and cyclohexane. This fraction is lowest in molecular weight, and has the highest hydrogen content.

The present invention addresses itself to the problem of maintaining the coal solvent in balance, sometimes referred to as "closure of the solvent balance". It will readily be appreciated that solvent loss may occur simply from normal handling procedures. In addition, there may be loss from cracking to lighter liquids. Still further, there may be solvent losses resulting from reactions and interactions occurring in the coal liquefaction zone itself, some of a thermal and others of a chemical nature. For instance, the solvent itself may be hydrogenated, dehydrogenated or hydrocracked; it may interact with thermally depolymerized coal molecules or radicals, or with a hydrogenated coal moiety. The resulting altered solvent, when it results in an increase in molecular weight is sometimes called "polymerized solvent" for convenience. A continuous commercial coal liquefaction process demands a closure of the solvent balance, and preferably without resort to the addition of extraneous make-up solvent which is expensive.

In accordance with my invention, I have provided an improved coal liquefaction process in which closure of the coal solvent balance is achieved.

The improved coal liquefaction process comprises, in its broadest aspects, the following steps:

(1) subjecting the coal to extraction with a distillable coal solvent in a coal liquefaction zone under conditions effective to produce an effluent slurry product, (2) effecting separation of said effluent slurry product into at least two parts, the first part being a low solids-containing product, and the second part being a high solids-containing product, (3) subjecting said first part to fractionation by the addition of a deasphalting solvent which preferentially separates asphaltenes and benzene insolubles therefrom leaving a separate oil-containing liquid phase, and (4) subjecting at least a portion of said liquid phase to hydrogenation under conditions selected to produce coal solvent.

The primary advantages of my improved process are successful closure of the coal solvent balance without extraneously derived make-up solvent, and avoidance of vacuum distillation to recover coal solvent from the effluent slurry product of the coal liquefaction step.

Figure 2:
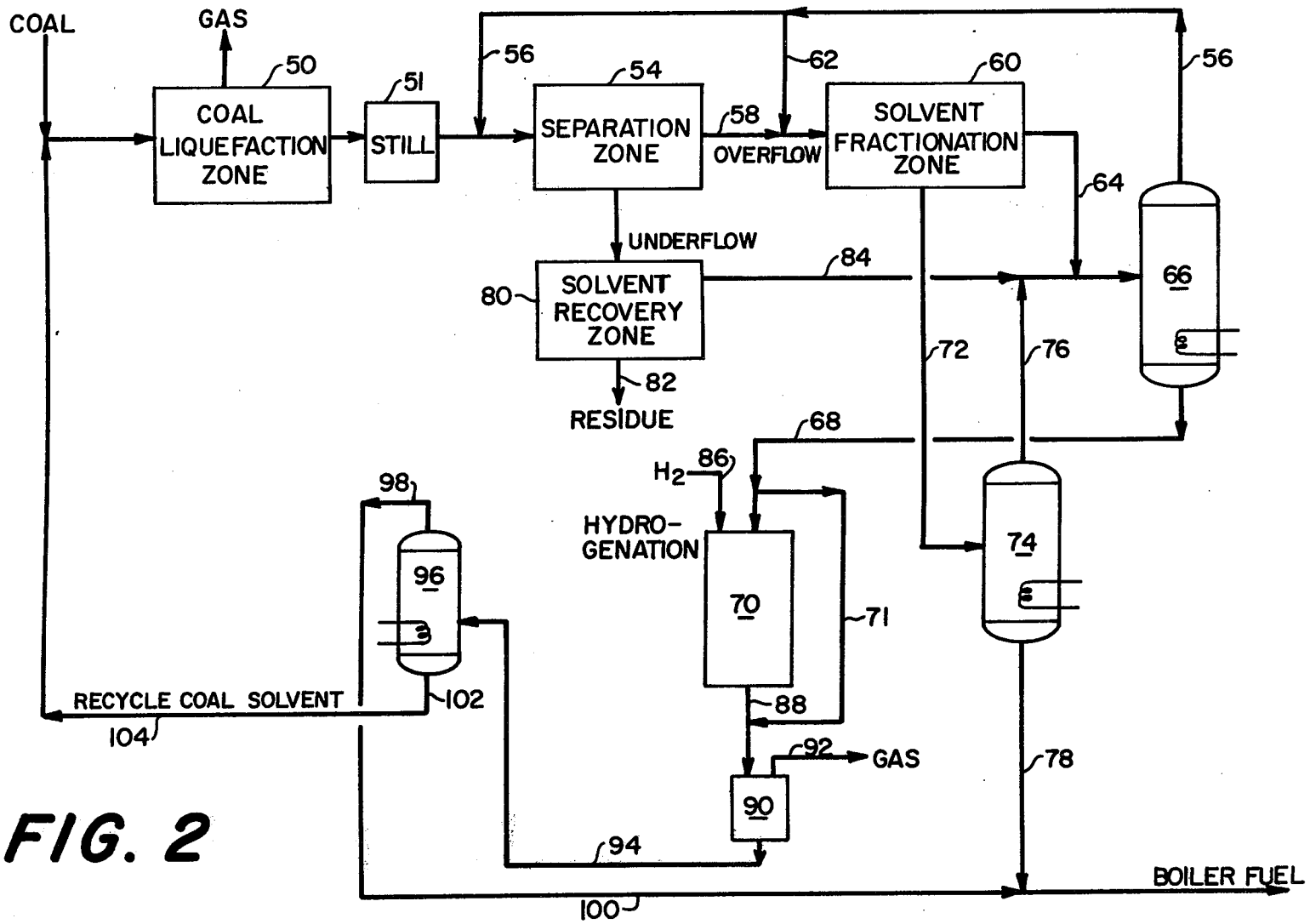

For a better and more complete understanding of my invention, its objects and advantages, reference should be had to the following detailed description and to FIGS. 1 and 2 of the accompanying drawings in which there are shown schematic flow-sheets of two preferred embodiments of my invention, respectively.

Referring to FIG. 1 of the drawings, comminuted coal, preferably a bituminous coal, is introduced into a Coal Liquefaction Zone 10 concurrently with a coal solvent and hydrogen in the gaseous state. A hydrotreating catalyst may be added if desired. Where a catalytic operation is used, Zone 10 preferably contains an ebullated bed of catalyst. The catalyst size is selected to permit the attrited coal residue to pass readily up through the interstices between the catalyst particles along with the liquids and the gases.

Suitable solvents for the coal in the Liquefaction Zone 10 are those which are predominantly polycyclic hydrocarbons, preferably partially or completely hydrogenated aromatics, including naphthenic hydrocarbons, which are liquid under the temperature and pressure of extraction. Mixtures of these hydrocarbons are generally employed, and may be derived from intermediate or final steps of the process of this invention. Those hydrocarbons or mixtures thereof boiling between about 260° C. and 475° C. are preferred. Examples of suitable solvents are tetralin, decalin, biphenyl, methylnaphthalene, and dimethylnaphthalene. Other types of coal solvent may be added to the above-mentioned types for special reasons, but the resulting mixture should be predominantly of the types mentioned, i.e. should constitute more than 50 percent by weight of the solvent used. Examples of additive solvents are the phenolic compounds, such as phenol, cresols and xylenols. The amount of the solvent generally ranges from 0.2 to 10 lbs. of solvent per pound of coal.

Examples of hydrotreating catalysts which may be used in the Coal Liquefaction Zone include those containing cobalt, molybdenum, nickel, tungsten, stannous chloride, iron oxide, vanadium sulfide, and any other hydrogenation catalyst capable of operation in the presence of sulfur-containing coal charge stocks.

This invention is especially useful when the liquefaction zone is conducted under relatively mild conditions which are conducive to causing development of a solvent deficiency. One or more of the following operating conditions may cause a solvent deficiency to develop, i.e. low residence time, low pressure and operation either without catalyst addition or with a very low catalyst replacement rate.

The operating conditions for the Coal Liquefaction Zone, not previously recited, include a temperature of about 375° C. to about 500° C., a hydrogen pressure from about 500 to about 3000 p.s.i.g., and a residence time from about 30 seconds to about 2 hours, and preferably so correlated as to dissolve in excess of 70% by weight of the m.a.f. (moisture- and ash-free) coal.

The liquefied effluent from the Coal Liquefaction Zone is a slurry containing coal solvent, polymerized solvent, extract and residue. Gases are discharged through a conduit 11. It will usually be desirable to remove the lower boiling fractions from the liquefaction effluent prior to the addition of the deashing solvent in the following separation step. This removal is done to provide a suitable boiling point gap between the deashing solvent and the initial boiling point of the coal solvent retained in the feed to the ash separation step. The recovery of the deashing solvent with minimal contamination is thus facilitated. Simultaneously, the size of the separation equipment is minimized. The removal of the lower boiling solvent from the extraction effluent may be effected either by flash or fractional distillation in a still 12. The optimum amount that is removed will generally be within the range of 15–85 percent of the coal solvent retained in the liquefaction effluent. The optimum amount of solvent to be removed is a function of the conditions employed in the liquefaction zone and the coal feedstock employed. Preferably, the amount of solvent removed will be in the range of 30–65 percent.

Following distillation, the effluent slurry product is conducted through a conduit 13 to a Separation Zone 14. Separation Zone 14 is preferably operated at a temperature between 260 and 320° C. The primary function of this zone is to selectively and controllably separate the effluent product into a first fraction which is substantially solids-free, and a second fraction which is solids-rich. The separation is preferably accomplished by the addition through a conduit 16 of a deashing solvent which is miscible with the coal solvent. The deashing solvent is preferably a saturated hydrocarbon. Paraffinic solvents, e.g. hexane, heptane, decane are especially suitable. Naphthenic hydrocarbons are also useful. A suitable deashing solvent may also be generated by saturation hydrogenation of a natural light oil derived from the liquefaction process. The volume ratio of the deashing solvent to the coal solvent preferably is between 0.1 and 1.0, and the temperature is maintained as close as possible to the temperature in the Liquefaction Zone without further heating since cooling of the effluent product may result in undesired precipitation of insoluble material from the extract. The conditions are now well known to effect precipitation of a controlled amount of high molecular weight material from the extract to form agglomerates composed of undissolved coal residue and the high molecular weight material from the extract as the binder. These agglomerates are allowed to settle at least sufficiently to leave a substantially solids-free supernatant liquid phase which includes the desired first fraction. The solids-rich phase is withdrawn as underflow through a conduit 18 to a Solvent Recovery Zone 20. Solvent plus retained deashing solvent is suitably flashed off at elevated temperature through a conduit 22 to distillation tower 42 where deashing solvent and solvent are recovered for recycle. The residue is discharged through a conduit 24 for use as a fuel or as feedstock to a gasifier for making fuel gas or hydrogen, for example.

The overflow from the Separation Zone 14 is composed of extract and polymerized solvent dissolved in the mixture of coal solvent and deashing solvent. This overflow is conducted through a conduit 26 to a Solvent Fractionation Zone 28. The primary function of this zone is to separate the asphaltene and benzene insoluble content of the extract from the coal solvent, the polymerized solvent and at least part of the oil content of the extract. The separation may be accomplished by well-known methods employed in petroleum technology such as the addition of "deasphalting" solvents. In the present instance, the deasphalting solvent serves as a fractionating solvent and is preferably the same as the deashing solvent used in the Separation Zone 14. Accordingly, the required deasphalting solvent may be withdrawn from the Fractionating Solvent Recycle conduit 16 through a conduit 30 in amount sufficient to effect the desired selective fractionation.

The separated asphaltenes and benzene-insolubles, are conducted as a separate liquid phase from the Solvent Fractionation Zone 28 through a conduit 32 to a flash still 34 for recovery of any accompanying distillables such as solvents. The latter are discharged overhead through conduit 36. The nondistillable but solids-free bottoms are recovered through a conduit 38 for use as a low-sulfur boiler fuel.

The "deasphalted" product obtained in the Solvent Fractionation Zone 28 is conducted along with distillables from conduit 36 through a conduit 40 to a fractional distillation tower 42. The primary functions of this tower are to recover the deasphalting solvent for recycle through overhead conduit and to recover a bottoms material composed of coal solvent, polymerized solvent and oil derived from the coal extract. Any surplus distillate, particularly that boiling outside the boiling range of the solvents is recovered through a conduit 44.

The bottoms material from the tower 42 is recycled through a conduit 46 to the Coal Liquefaction Zone 10. The recycled polymerized solvent is restored to useful solvent by virtue of the hydrotreating conditions maintained in the Liquefaction Zone 10, whereby the quantity of polymerized solvent in the Liquefaction Zone is maintained at an equilibrium value. At the same time, the recycled oil is converted at least in part to distillables which contain make-up coal solvent, as well as other high quality distillables.

Referring to FIG. 2 of the drawings, comminuted coal is introduced into a Coal Liquefaction Zone 50 concurrently with 0.5 to 4.0 parts by weight of a H-donor (hydrogen-transferring) solvent. The Zone 50 is adapted to confine the coal and the solvent for a residence time from about two minutes to two hours at elevated pressures and temperatures. The residence period and temperatures are determined by the specific solvent and the desired depth of coal extraction. The required residence time generally decreases with increasing temperature. The pressure is that required to maintain the solvent as a liquid at the selected temperature, generally in the range of 1 p.s.i.g. to 6500 p.s.i.g.

Suitable H-donor solvents for the coal are those distillable hydrogen-transferring solvents such as tetralin or mixtures of hydrocarbons derived from intermediate or final steps of the process. The latter are preferably predominantly polycyclic hydrocarbons, which are partially hydrogenated aromatics, that are liquid under the temperature and pressure of extraction. Those hydrocarbons or mixtures thereof boiling between about 260° C. and 475° C. are preferred.

As stated above, the coal is comminuted, and preferably of a fluidizable size, for example −14 mesh Tyler Standard screen. UP to about 25 percent depth of extraction, the coal particles retain substantially their original size; beyond 25 percent extraction, the particles undergo degradation.

The coal and the H-donor solvent are maintained in intimate contact within the Liquefaction Zone 50 until the solvent has dissolved the desired amount of coal. The temperature of the Liquefaction Zone should be between 300° C. and 500° C. Polymerization of the solvent always occurs as an adjunct of the hydrogen transfer process. Ultimately, a loss of available solvent occurs unless corrective measures are adopted aimed at recovering any lost solvent.

Following extraction, as in the case of the process of FIG. 1, the mixture of coal solvent, polymerized solvent, coal extract and residue is conducted to a still 51 to remove the lower boiling fractions. Following distillation, the effluent slurry product is conducted through a conduit 52 to a Separation Zone 54. The primary function of this zone is to separate the mixture into a solids-rich fraction and a low solids fraction. This separation is accomplished by the addition to the Separation Zone 54 by a conduit 56 of a deashing solvent, e.g. a saturated hydrocarbon, for example a paraffinic solvent, such as hexane, heptane, or decane, in a volume ratio of the paraffinic solvent to the coal solvent between 0.1 and 1.0 sufficient to cause precipitation of a controlled amount of benzene-insolubles from the extract. The precipitating solvent serves as an aid to the subsequent separation of the solids (residue) since the precipitated benzene-insolubles act as a binder for the finely divided solids to cause them to form agglomerates which readily settle by gravity. The actual separation of the solvent phase from the solids-containing phase may be by any suitable conventional means, but gravity settling is preferred thus permitting simple decantation for the separation of a solids-free overflow and the solids-rich underflow.

The overflow from the Separation Zone 54 is conducted by a conduit 58 to a Solvent Fractionation Zone 60 whose primary purpose is to separate the higher molecular weight materials, i.e. asphaltenes and benzene-insolubles of the extract from the solvents, the lowest molecular weight content (i.e. oil) of the extract and the polymerized solvent. Preferably the fractionating or deasphalting solvent is the same as the precipitating solvent used in the Separation Zone 54 and is introduced by an interconnecting conduit 62. The amount of added deasphalting solvent is selected to effect the desired fractionation. The temperature of fractionation is maintained sufficiently high so that two liquid phases are formed, the more viscous asphaltene-containing phase being the lower. The two liquid phases may be readily separated by decantation. The upper layer is conducted by a conduit 64 to a distillation zone 66 whose purpose is simply to remove the low boiling deasphalting solvent for recycle through conduit 56. The bottoms portion consisting essentially of solids-free high quality extract, (oil) coal solvent (depleted of hydrogen) and polymerized solvent is conducted by a conduit 68 to hydrogenation zone 70. A valved by-pass 71 is provided to regulate the amount subjected to hydrogenation; preferably after fractionation (not shown) so that not all the coal solvent passes through the hydrogenation zone.

The underflow from the Solvent Fractionation Zone 60 is conducted by a conduit 72 to a distillation zone 74 whose primary function is to recover any solvents as overhead distillate. The latter is conducted via conduit 76 to join conduit 64 and thence into distillation zone 66 to assure recovery and separation of solvent. The remainder is recovered through conduit 78 to serve as a low sulfur fuel oil.

The solids-rich underflow from the separation zone 54 is conducted to a Solvent Recovery Zone 80. Any residual solvent and precipitating solvent may be suitably recovered here. The residue may be conveniently withdrawn through conduit 82 for use as feedstock to a gasifier. The recovered solvents are conducted by a conduit 84 to distillation zone 44 for recovery of contained precipitating solvent.

The primary purpose of the hydrogenation unit 70 is to catalytically hydrogenate the H-donor coal solvent which had been previously depleted of its hydrogen, to further restore the polymerized solvent to its pristine H-donor effectiveness, and to convert the oil from the extract to distillables containing some boiling in the coal solvent range. Conventional petroleum hydrodesulfurization catalysts may be used. Hydrogen is fed through a conduit 86. The effluent product is withdrawn through a conduit 88 to a hot separator 90 from which non-condensable gases are discharged through a conduit 92.

The effluent liquid product is transferred through a conduit 94 to a fractional distillation column 96. The lighter boiling material (that is, boiling below the coal solvent) is removed as light oil through a conduit 98 to a product line 100. The higher boiling fraction is recovered through a conduit 102 for recycle through a conduit 104 to the coal H-donor extraction zone. If more of such product is produced than is required for solvent recycle, the surplus is diverted to the product line 100.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

I claim:

1. In a coal liquefaction process wherein (a) a distillable coal solvent is used in a hydroextraction zone to yield a product from which a slurry is recovered that consists essentially of extract and polymerized solvent dissolved in said coal solvent and undissolved solids, and (b) said slurry is separated into a first fraction which is substantially solids-free, and a second fraction which is solids-rich, said first fraction containing extract and polymerized solvent dissolved in coal solvent, the improvement whereby the coal solvent is maintained in balance which comprises:

(1) conducting said first fraction to a solvent fractionation zone, without any intervening distillation;

(2) adding a deasphalting solvent to said solids-free first fraction in said solvent fractionation zone under conditions effective to separate the asphaltene and benzene insoluble content of the extract from the coal solvent, polymerized coal solvent and at least part of the oil content of the extract;

(3) recovering from said solvent fractionation zone the separated coal solvent, polymerized solvent and oil; and (4) subjecting said separated coal solvent, polymerized solvent and oil, in admixture, to hydrogenation under conditions effective to regenerate coal solvent from the polymerized solvent and to convert the oil to a distillable product containing said coal solvent.

2. In a coal liquefaction process wherein (a) a distillable coal solvent composed predominantly of polycyclic hydrocarbons is used in a hydroextraction zone under conditions effective to yield a product from which a slurry is recovered containing coal solvent, polymerized solvent, extract and residue, and (b) a deashing solvent miscible with the coal solvent and composed of paraffinic hydrocarbons is added to said slurry in a separation zone under conditions effective to separate said slurry into a first fraction which is substantially solids-free and a second fraction which is solids-rich, said first fraction being composed of extract and polymerized solvent dissolved in the mixture of coal solvent and deashing solvent, the improvement whereby the coal solvent is maintained in balance without extraneously derived make-up coal solvent which comprises:

(1) conducting said first fraction to a solvent fractionation zone, without any intervening distillation;

(2) adding a deasphalting solvent composed of paraffinic hydrocarbons to said first fraction in said solvent fractionation zone under conditions to effect formation of two liquid phases, the more viscous asphaltene-containing phase being the lower, the upper phase consisting essentially of coal solvent, deashing solvent, deasphalting solvent, polymerized coal solvent and oil derived from the extract;

(3) separating said two liquid phases and conducting said upper liquid phase to a distillation zone wherein the deashing solvent and the deasphalting solvent are recovered and recycled to their respective zones; and (4) subjecting a bottoms portion recovered from said distillation zone which consists essentially of oil, coal solvent and polymerized solvent to hydrogenation under conditions effective to regenerate coal solvent from the polymerized solvent and to convert the oil to a distillable product containing said coal solvent.

3. The process according to claim 2 wherein said deashing solvent and said deasphalting solvent are composed of the same paraffinic hydrocarbons.

4. The process according to claim 3 wherein the hydrogenation of step (4) is conducted in said hydroextraction zone.

5. The process according to claim 3 wherein the hydrogenation of step (4) is conducted in a hydrogenation zone separate from said hydroextraction zone.

* * * * *